US006905096B1

(12) United States Patent
Tabor et al.

(10) Patent No.: US 6,905,096 B1
(45) Date of Patent: Jun. 14, 2005

(54) KITE WITH PLANAR AERODYNAMIC SURFACE

(76) Inventors: Don Tabor, 556 Florence St., Imperial Beach, CA (US) 91932; Francis A. Alonso, 30765 Pacific Coast Hwy. #300, Malibu, CA (US) 90265

( * ) Notice: Subject to any disclaimer, the term of this patent is extended or adjusted under 35 U.S.C. 154(b) by 0 days.

(21) Appl. No.: 10/734,045

(22) Filed: Dec. 11, 2003

(51) Int. Cl.[7] ..... B64C 31/06; A63H 27/08
(52) U.S. Cl. ..... 244/153 R; D21/445
(58) Field of Search ..... 244/153 R, 154, 244/155 R; 446/199; D21/445

(56) References Cited

U.S. PATENT DOCUMENTS

| | | | | | |
|---|---|---|---|---|---|
| 606,960 | A | * | 7/1898 | Doyle | 244/153 R |
| 666,427 | A | | 6/1901 | Lamson | |
| 770,626 | A | | 9/1904 | Graham | |
| 1,927,835 | A | * | 9/1933 | Kellogg | 244/154 |
| 2,035,730 | A | | 3/1936 | Trevor | 244/22 |
| 2,124,992 | A | | 9/1938 | Wood | 244/154 |
| 2,240,881 | A | | 5/1941 | Bradford | 244/154 |
| 2,386,762 | A | | 10/1945 | Wheelwright | 244/153 |
| 2,537,560 | A | | 1/1951 | Wanner | 244/153 |
| 2,744,701 | A | | 5/1956 | Robey | 244/153 |
| 2,827,252 | A | | 3/1958 | Pohl | 244/154 |
| 3,018,075 | A | | 1/1962 | Bowers | 244/153 |
| 3,039,722 | A | | 6/1962 | Eustis | 244/153 |
| 3,076,626 | A | | 2/1963 | Andrews | 244/154 |
| 3,098,634 | A | | 7/1963 | Finklea | 244/153 |
| 3,276,730 | A | | 10/1966 | Cleveland | 244/153 |
| 3,305,198 | A | | 2/1967 | Sellers, Jr. | 244/153 |
| 3,327,975 | A | | 6/1967 | Vaughan | 244/153 |
| 3,468,503 | A | | 9/1969 | Snibbe | 244/153 |
| 3,494,578 | A | | 2/1970 | Cureton | 244/153 |
| 3,920,201 | A | * | 11/1975 | Battles | 244/16 |
| 3,937,426 | A | | 2/1976 | Pearce | 244/153 |
| 4,076,189 | A | | 2/1978 | Powell | 244/153 |
| 4,198,019 | A | | 4/1980 | Linczmajer | 244/123 |
| 4,450,784 | A | * | 5/1984 | Mellinger | 114/39.26 |
| 4,655,720 | A | * | 4/1987 | Renger et al. | 446/61 |
| 4,807,832 | A | | 2/1989 | Tabor | 244/153 |
| 4,815,681 | A | | 3/1989 | Crowell | 244/153 |
| 5,098,039 | A | | 3/1992 | Linden | 244/153 |
| 5,127,611 | A | | 7/1992 | Payne | 244/153 |
| 5,328,134 | A | | 7/1994 | Powers | 244/155 |
| 5,573,208 | A | | 11/1996 | Cassagnes | 244/153 |
| 5,833,174 | A | | 11/1998 | Knight | 244/155 |
| 6,003,816 | A | | 12/1999 | Lee | 244/153 |
| 6,062,510 | A | | 5/2000 | De La Melena | 244/153 |

* cited by examiner

*Primary Examiner*—Robert P. Swiatek
(74) *Attorney, Agent, or Firm*—Louis J. Bachand

(57) ABSTRACT

A kite system including a base, a substantially exposed substructure coupled to the base to flex the base, and one or more masts and sails coupled to the base.

25 Claims, 7 Drawing Sheets

KITE WITH PLANAR AERODYNAMIC SURFACE

BACKGROUND

The popularity of kites has boomed in recent decades, and novelty kites are particularly in demand since many consumers want kites that are unique, that stand out from the rest of the kites, and that constitute a personalized expression that consumers want to make.

Very few flying toys include a substructure and make it appear as though the flying toy is imitating the movements of a similar real world device and/or person. Even fewer may include a toy human figure or other weighted mass suspended from the toy that change the flight characteristics of the toy and imitate the movements of a real person would appear on a similar real-world device.

SUMMARY

A kite system including a base, a substantially exposed substructure coupled to the base, and one or more sails coupled to the base, is provided.

Furthermore, the kite system may include a ballast that may be configured to be selectively, positionally couplable to the kite system, and may move relative to the kite during flight. The ballast may be in the form of a human, an animal, a fanciful creature, or even an inanimate object.

In an exemplary embodiment, the kite system may be similar to a surfer and surfboard or sailboard. According to another exemplary embodiment, the kite may be similar to the form of a vehicle with wheels, such as a skateboard and skateboarder. In another exemplary embodiment, the flying toy may be similar to the form of a golf putting green with a golfer.

DETAILED DESCRIPTION

The detailed description set forth below in connection with the appended drawings is intended as a description of exemplary embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
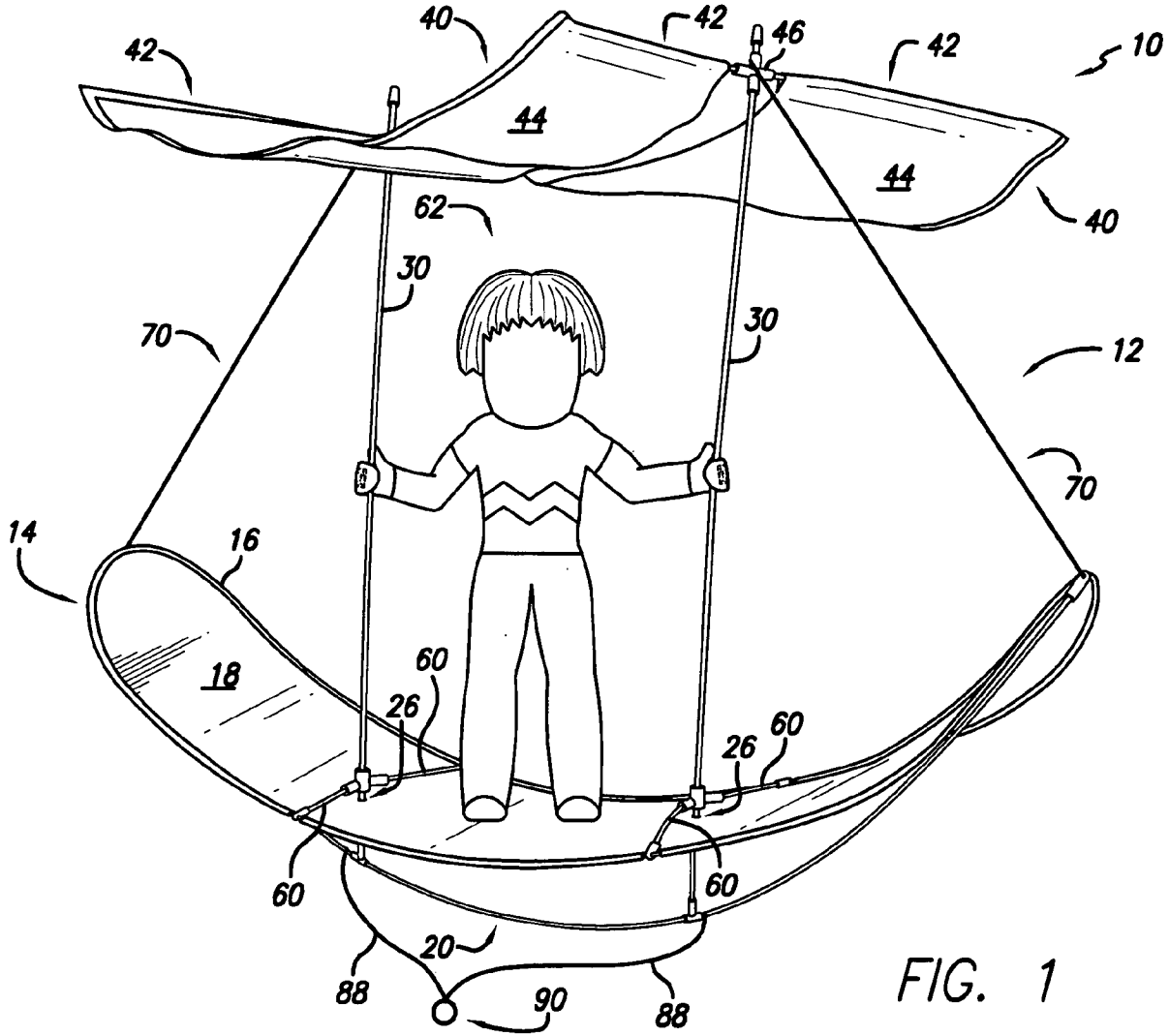
FIG. 1 is a perspective view of a flying toy in the form of a sailboard kite, including a sub-structure and ballast in accordance with one exemplary embodiment.

FIG. 1 shows a flying toy system according to one exemplary embodiment, generally at 10. System 10 may include a kite portion 12 and ballast 62 coupled to the kite portion 12. Kite portion 12 may include a base 14, masts 30 that are coupled to the base 14, and sails 40 that may be coupled to masts 30. Base 14 may include a frame 16 that may be coupled to an inner body portion 18 to form base 14. Base 14 may be formed such that it may be folded to reduce its size for shipping, storage, and display.

Furthermore, sails 40 may be detachable from the system, and foldable for ease of transportation, packaging, shipping storage and display. With this configuration, the system may be enclosed in a smaller package, such that more can be shipped at one time and retailers would be more likely to carry the product.

System 10 also may include a substructure 20 that may be configured to couple to base 14 at opposite ends of base 14, such that the kite portion may be stabilized for flight, and such that the flight characteristics may be changed. Substructure 20 also may couple to masts 30, which may extend through inner body portion 18 of base 14 to further stabilize the system. Masts 30 may couple to base 14 or may pass through orifices 26 in body portion 18, as desired. Substructure 20 may be configured to flex base 14, and may alter the flight characteristics of the system.

Kite portion 12 further may include rigging 70 that may be coupled to masts 30 and base 14. Rigging 70 may provide tension to bend, flex or alter the configuration of base 14, and may also be utilized to stabilize the system. Rigging 70 may be coupled to base 14 at opposite sides, near where substructure 20 is coupled, such that they may be similar to real world mast stays. However, it will be appreciated that rigging 70 may be coupled to masts or other portions of base 14 such as the sides, such that they may be similar to shrouds of a real sailing vessel. Rigging 70 may be made out of string, rope, or other material that may be utilized for this purpose. Rigging 70 and/or substructure 20 may flex base 14 in varying amounts to change the flight characteristics of the system, as desired.

System 10 may further include sails 40, which may include poles 42 that may be coupled to a sail portion 44 and also coupled to masts 30 via a mast connector 46. Sails 40 may provide lift for the system and add to the aesthetic appearance of the system. Although two sail portions are shown, it will be appreciated that any number of sails may be utilized, as desired, including one or more sail portions 44. Masts 30 may be plastic rods, but may be made of other materials, as desired. Masts 30 may couple to sails 40, extend through base 14, and connect to substructure 20 via a rubber-like connector, or other connector such as those used in kite making. However, it will be appreciated that other connection-methods and structures may be utilized as desired.

Kite portion 12 also may include lateral supports 60 that may couple to masts 30 and to base 14. Lateral supports 60 may connect to base 14 on opposite sides and masts 30 between lateral supports 60, however, other configuration may be utilized, as desired. Lateral supports 60 may couple to masts 30 via lightweight rubber-like connectors, or other connectors. However, it will be appreciated that other methods of coupling lateral supports to masts and to base may be utilized, as desired.

Base 14 may be configured such that it may be folded or otherwise made into a smaller configuration such that it will take up less space in packaging, shipping, storage and display.

Additionally, the system 10 may have string segments 88 which may be approximately 10–30 inches in length, which may connect to the front and rear of the substructure, however, they may also connect to other portions of the system, as desired. The string segments may be joined at a common point, which may include a connecting structure 90 as shown in the figure, for connection to a third long string (not shown) held by the user. Connecting structure 90 is shown as a ring-type connector, however, it will be appreciated that other connecting structures may be utilized, as desired. It will be appreciated, however, that other configurations and materials may be utilized, as desired.

System 10 also may include a ballast 62, which may be selectively positionally couplable to kite portion 12. Ballast 62 is removably, selectively, positionally coupled to kite portion 12 to alter the appearance, and the flight characteristics of the entire system, when in flight. Ballast 62 may be coupled to kite portion 12 above base 14; however, other configurations may be utilized, as desired. Ballast 62 may also move continually or intermittently when in flight, thereby changing the flight characteristics of the system 10. The flight characteristics include, but are not limited to, the center of gravity, the altitude and direction the kite is flying, and the airspeed of the kite, among others.

Figure 5:
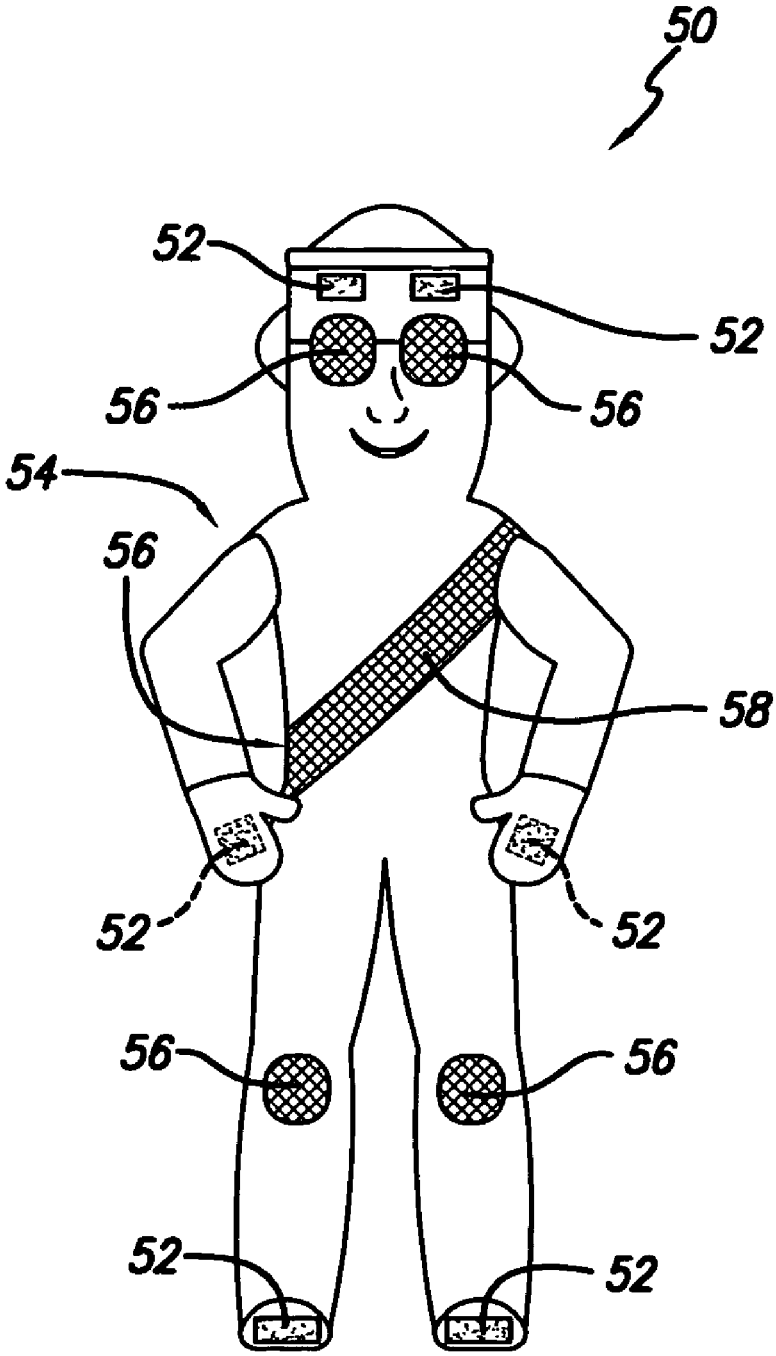
FIG. 5 is a perspective view of a ballast according to an exemplary embodiment.

This configuration may therefore make the system imitate a real world surfer and surfboard riding on water, bouncing over waves, and the like. Ballast 62 also may include coupling structures that allow it to couple to itself or the kite in many different positions throughout the system. With this configuration, ballast 62 may be coupled to the kite portion 12 in many different positions and configurations to alter the appearance and the flight characteristics of the system when in flight, as desired. The coupling structures 52 may be located at many positions on the surfaces of ballast 62. For example, FIG. 5 illustrates coupling structures 52 located on the hands and feet, as well as other locations of a ballast 50 in the form of a human windsurfer. The present invention also contemplates many other forms of the ballast and many other locations for the coupling structures 52, such as in the seat area of a human or animal figure for the effect of emulating sitting, or the back area for emulating a soaring effect by the figure. Kite portion 12 may be made from nylon, fabric, and plastic and rubber-like compounds, but also may be made from other materials, as desired.

Figure 2:
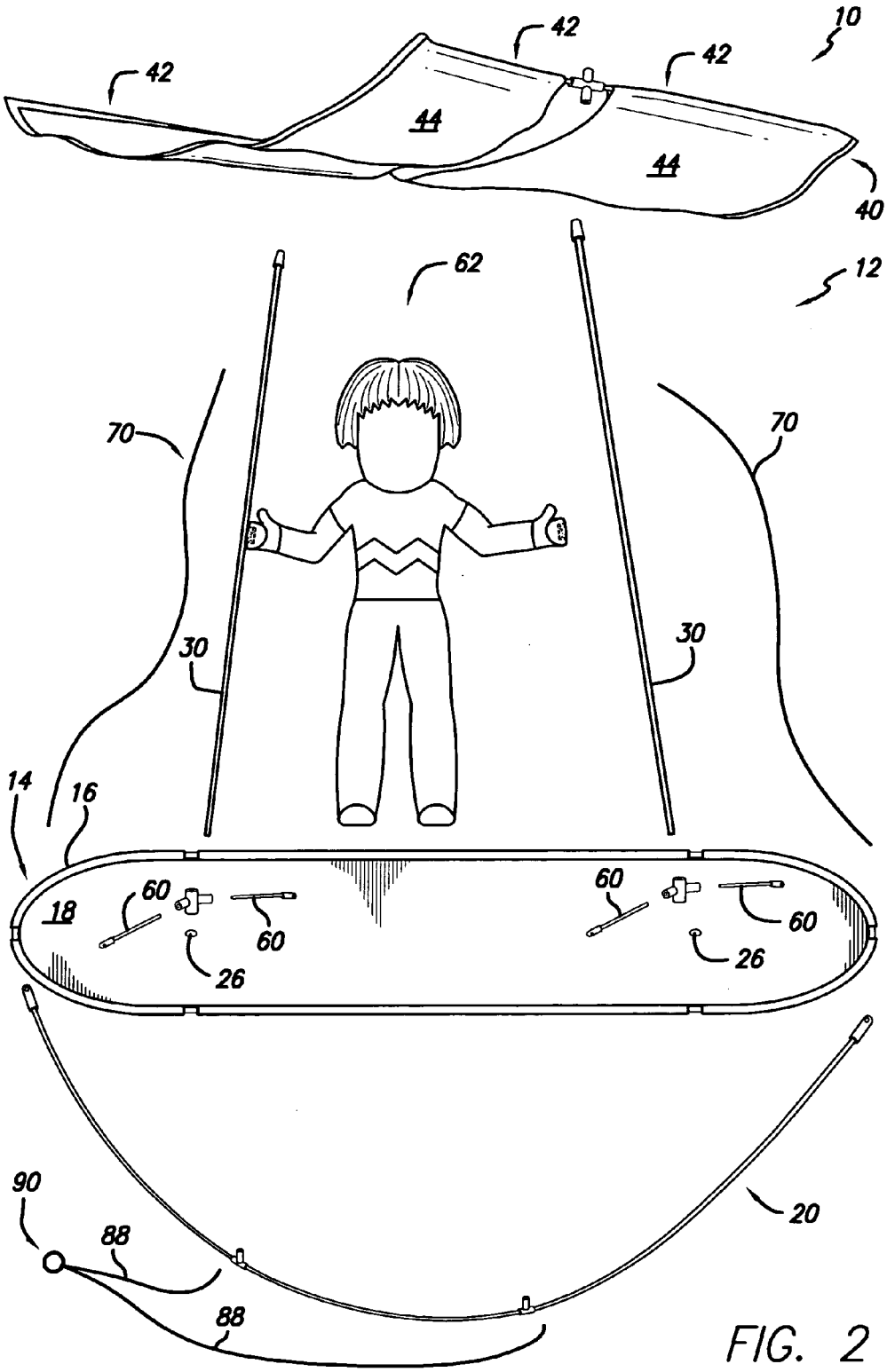
FIG. 2 is an exploded view of the kite of FIG. 1.

FIG. 2 shows an exploded view of the flying toy system of FIG. 1 generally at 10. Again, system 10 may include a ballast 62 and a kite portion 12. System 10 may again include sails 40 which may include poles 42 which may be sewn into the body of sail portions 44. Poles 42 may couple to masts 30 and to sails 44.

System 10 also may further include rigging 70 that may be coupled to masts 30 and/or sails 40. Kite portion 12 again may include a base 14 which may be made up of a frame 16 and a body portion 18. Masts 30 may extend through orifices 26 and body portion 18 and may couple to a substructure 20. Substructure 20 again may provide stability and may provide a force that bends, flexes or deforms base 14 along with rigging 70. This may change the flight characteristics of the overall system and may be modified, as desired.

System 10 also may include lateral supports 60 that may be coupled to masts 30 and to base 14 at frame 16. Lateral supports 60 may provide support for the overall system and may add rigidity and strength to alter the flight characteristics also.

In this exemplary embodiment, ballast 62 is in the form of a human or surfer, and may be coupled at many points of the system, as desired.

System 10 also may include string elements 88 that may be coupled to the base structure or substructure or other location of system 10 such that they may connect to connecting structure 90 that may be configured to couple to a kite string held by the user.

Figure 3:
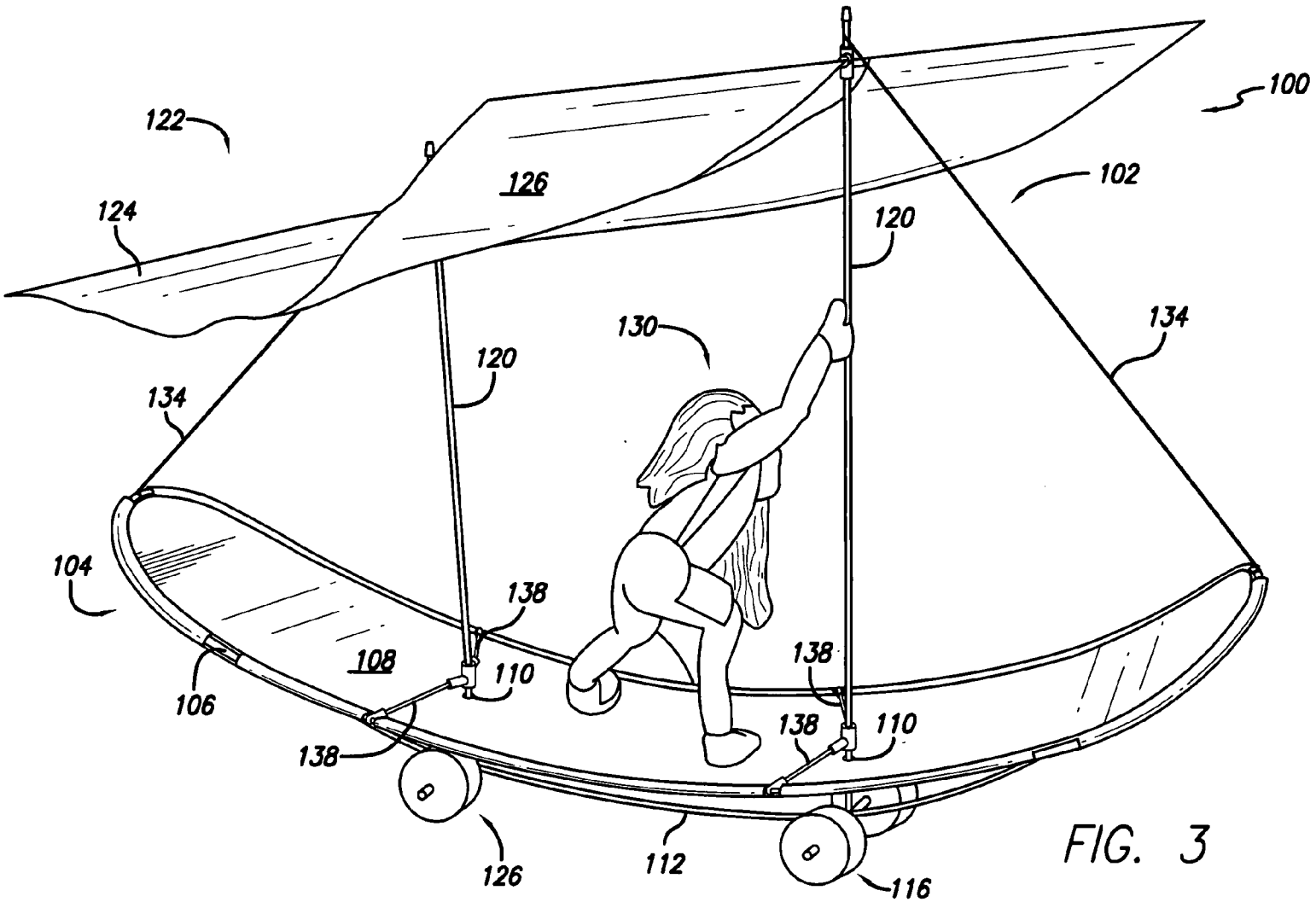
FIG. 3 is a perspective view of a flying toy in the form of a skateboard kite according to an exemplary embodiment.

FIG. 3 depicts another exemplary embodiment of a flying toy system generally at 100. System 100 may include a kite portion 102 and a ballast 130, similar to an earlier exemplary embodiment. System 100 may again include a base 104, which may include a frame 106 and a body 108. Masts 120 may be coupled to sails 122 and extend through orifices 110 in body 108 and couple to substructure 112. In this embodiment, system 100 may include wheels 116, which may couple to substructure 112 and/or to masts 120, such that the system looks similar to a skateboard with sails, or the like.

Sails 122 again may include poles 124, which may be coupled to sail portions 126. Poles 124 may couple to sail portions 126 by being hemmed into them, however other configurations may be utilized, as desired. Sails 122 may also couple to masts 120, which may provide lift for the entire system.

System 100 also may include rigging 134 that may be coupled to masts 120 and base 104, but may be coupled to other portions of the system including sails, and the like. System 100 may further include lateral supports 138, which may couple to masts 120 and to frame 106 and may add stability to the system.

Wheels 116 may be for ornamental purposes, and/or may change the flight characteristics of the system. Furthermore, configurations other than wheels may be utilized to enhance the functionality and aesthetics of the system, as desired. Ballast 130 may be in the shape of a human, such as a longhaired skateboarder dude, but may be other forms, as desired.

Figure 4:
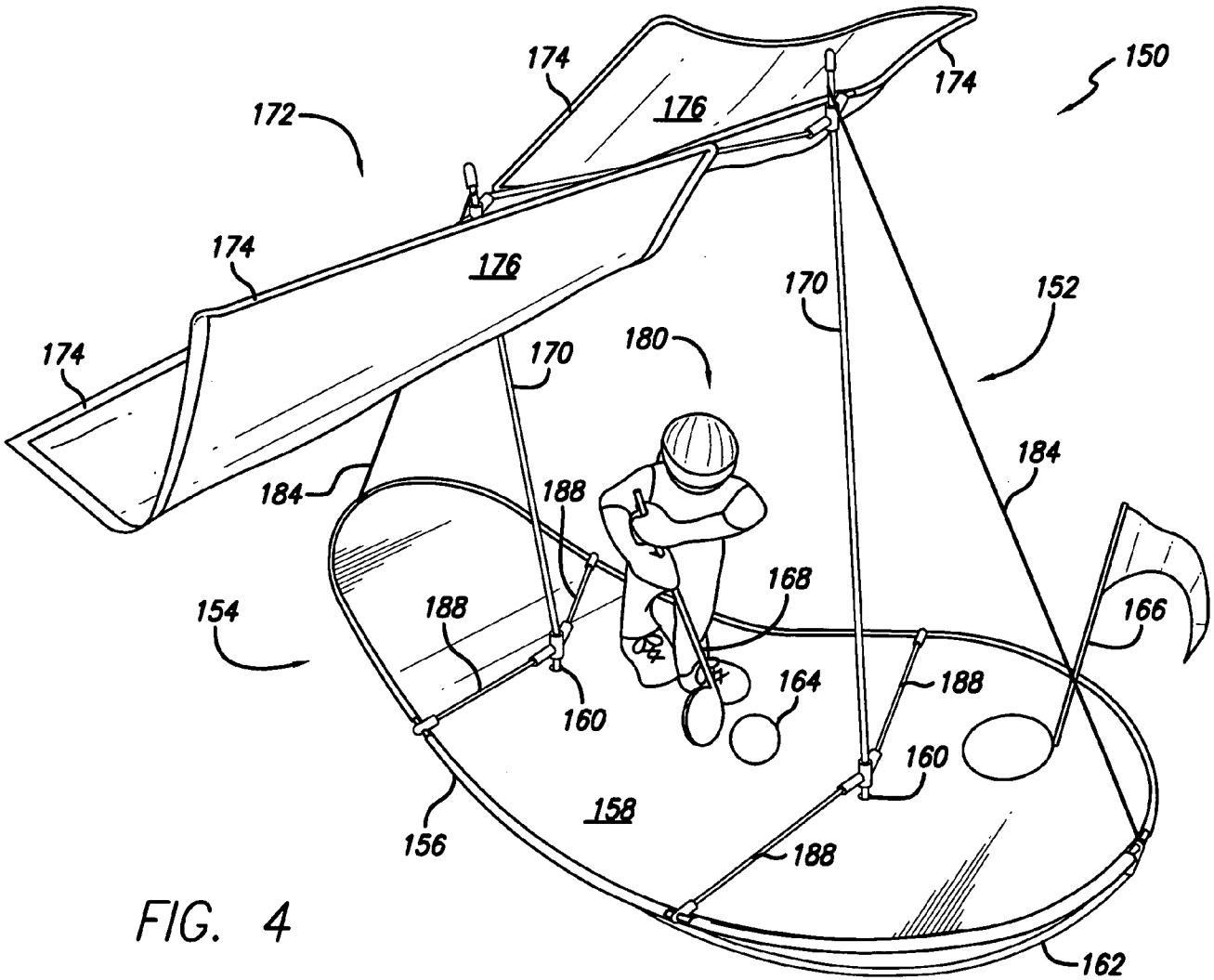
FIG. 4 is a perspective view of a flying toy in the form of a golf putting green and golfer kite according to an exemplary embodiment.

FIG. 4 is an exemplary embodiment of a flying toy system, shown generally at 150. System 150 may include a kite portion 152 and a ballast 180. System 150 further may include a base portion 154, which may include a frame 156 and a body 158. In this exemplary embodiment, the base takes the form similar to a putting green with ballast 180 being similar to that of a golfer. Further included in this embodiment are a club 168, a ball 164, and a flag 166 simulating a golf club, golf ball, and a flag stick, respectively. It will be appreciated that these novelties may be other forms depicting other sporting equipment and playing fields, and the like. System 150 also may include sails 172, which may include poles 174 and sails 176, which may be coupled to the other. Sails may be coupled to masts 170, which may extend through orifices 160 and may connect to substructure 162.

Again, substructure 162 and rigging 184 may be utilized to provide flexure to the base and add stability to the overall system, such that desirable flight characteristics may be achieved. System 150 also may include a base portion 154, which may include a frame 156 and a body 158, similar to previous embodiments. System 150 also may include lateral supports 188 which may couple to masts 170 and to frame 156 to add stability and support for the overall system.

FIG. 5 is a ballast 50 according to an exemplary embodiment. Ballast 50 may include coupling structures 52 located at various portions of ballast 50. Coupling structures 52 may be hook-and-loop coupling structures such that they may couple to themselves and each other, and they may couple to other coupling structures located throughout the system. With this configuration, ballast 50 can be coupled in an infinite number of positions to simulate the movements of an actual sailboarder, skateboarder, golfer, or the like.

Ballast 50 may include a shell 54 and mesh portions 56 such that air will pass through mesh portions 56 to inflate the ballast 50 when in flight. Ballast 50 also may include fill material 58 on the interior of shell 54 that may assist in keeping the shape of ballast 50 when not inflated.

Shell 54 may be configured to catch air, to deflect air, and to change the characteristics of the ballast 50, and consequently the flight characteristics of the overall system when in flight. Mesh portion 56 may allow air to pass through to inflate ballast 50 and to allow shell 54 to deflect air. In this figure mesh portions 56 are shown as the eyes and near the knees of the human-like figure, as well as a sash running across the chest of the human figure. It will be appreciated that other configurations may be utilized to change the characteristics of ballast 50, and the system, as desired.

The figure, as shown in FIG. 1, alternatively may be constructed not to include a mesh portion. The ballast or figure may be configured in part or entirely of a flexible material and filled with a fill material that will allow the ballast to keep its shape without resorting to mesh air-intake portion. This embodiment may be configured to allow a substantial amount of air to pass through it to inflate the ballast.

Ballast 50 may include coupling structure 52 that may allow it to couple to kite portion 12 in many different positions and locations. Coupling structure 52 may be a hook-and-loop configuration such that it may couple to itself or to the kite portion, such that ballast 50 may be coupled around, or to, any portion of the system 10. It will be appreciated, however, that other coupling structures may be utilized, as desired. It will also be appreciated that, although certain locations on ballast 50 for coupling structure 52 are shown in FIG. 4, numerous locations for coupling structure 52 may be utilized, including most or all of ballast 50, as desired. For example, the hands of the figure may be coupled at low points of the kite, such that the figure appears to be bending. Additionally, the figure may be formed with slightly bending knees to more closely resemble the form of a human operating a sailboat, sailboard, skateboard, or the like.

Ballast 50 may be made of lightweight material such as nylon, plastic, or rubber-like materials, that are flexible, but may also be rigid, or partially rigid, or combinations thereof. With this configuration, ballast 50 may be connected at certain points of ballast 50 to kite portion 12 such that the remainder of ballast 50 will move continually or intermittently during flight of the system with respect to kite portion 12. Furthermore with this configuration, different points of ballast 50 may be connected to numerous different points of kite portion 12, as desired. The ballast 50 may include slightly bent knees and may be approximately 12–20 inches tall and may have average head and body diameters of approximately 1–4 inches, and weigh about 0.4–2.0 ounces. However, it will be appreciated that the present invention equally contemplates systems and elements that are other sizes, including but not limited to, fractions of an inch to many feet in size, as desired.

Ballast 50 also may include fill material 58 to add weight to the system as well as to keep the form of ballast 50. Fill material is typically foam, or other lightweight fill material. It will be appreciated that other materials may be utilized such as cotton, feathers, or synthetic filling, typically used for stuffing plush animals, pillows, and the like, which may aid in maintaining the shape of ballast 50, as desired.

The size and weight of the ballast may be comparable to that of the kite and/or system, such that the ballast may be weighted sufficiently to affect the flight characteristics of the kite, whereby movement of the ballast during flight and/or wind effects on the ballast itself may cause significant changes in the kite's flight characteristics.

Figure 6:
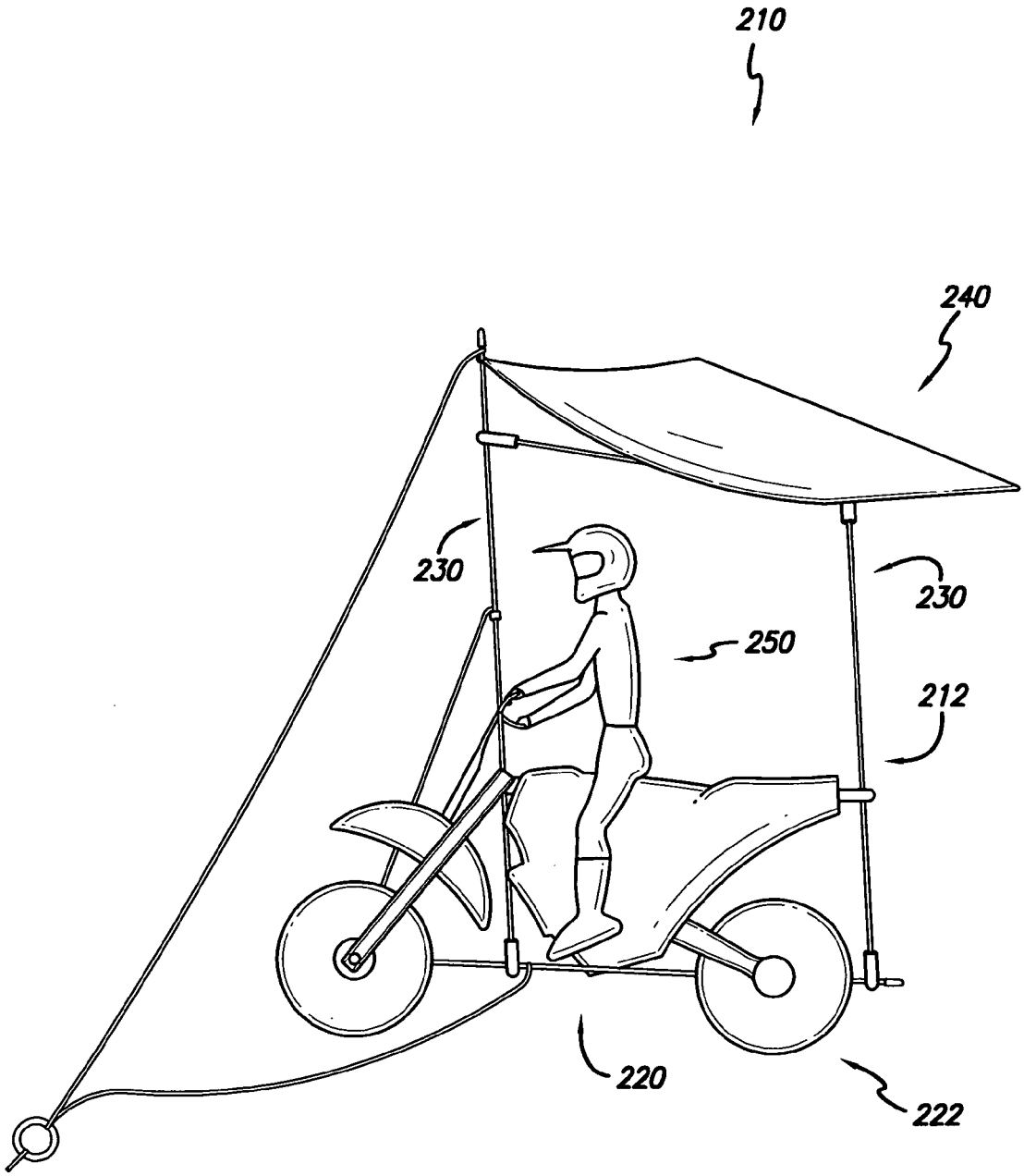
FIG. 6 is a perspective view of an exemplary embodiment.

FIG. 6 is an exemplary embodiment of a system, which may be of the likeness of a motorcycle and rider, generally at 210. System 210 may include a kite portion 212 and a ballast portion 250. Here the system may be in a form similar to a motorcycle and rider. Similarly, the system may be in the form of a bicycle, unicycle, Segway-type device, or other device with, or without a rider. Kite portion 212 may include sails 240 and masts 230, which may provide stability and lift for the system.

System 210 may include substructure 220, which may be all, partially or not exposed. System 210 may include wheels 222, which may alter the flight characteristics of the system, and/or may add to the aesthetic appeal of the system. Furthermore, substructure 220 may add stability to the system, which may allow the system to operate better and more consistently.

Ballast 250 may be in the form of a rider, but could be other configurations as desired. Ballast 250 may or may not include mesh, which may alter the characteristics of the ballast and system, as desired.

Figure 7:
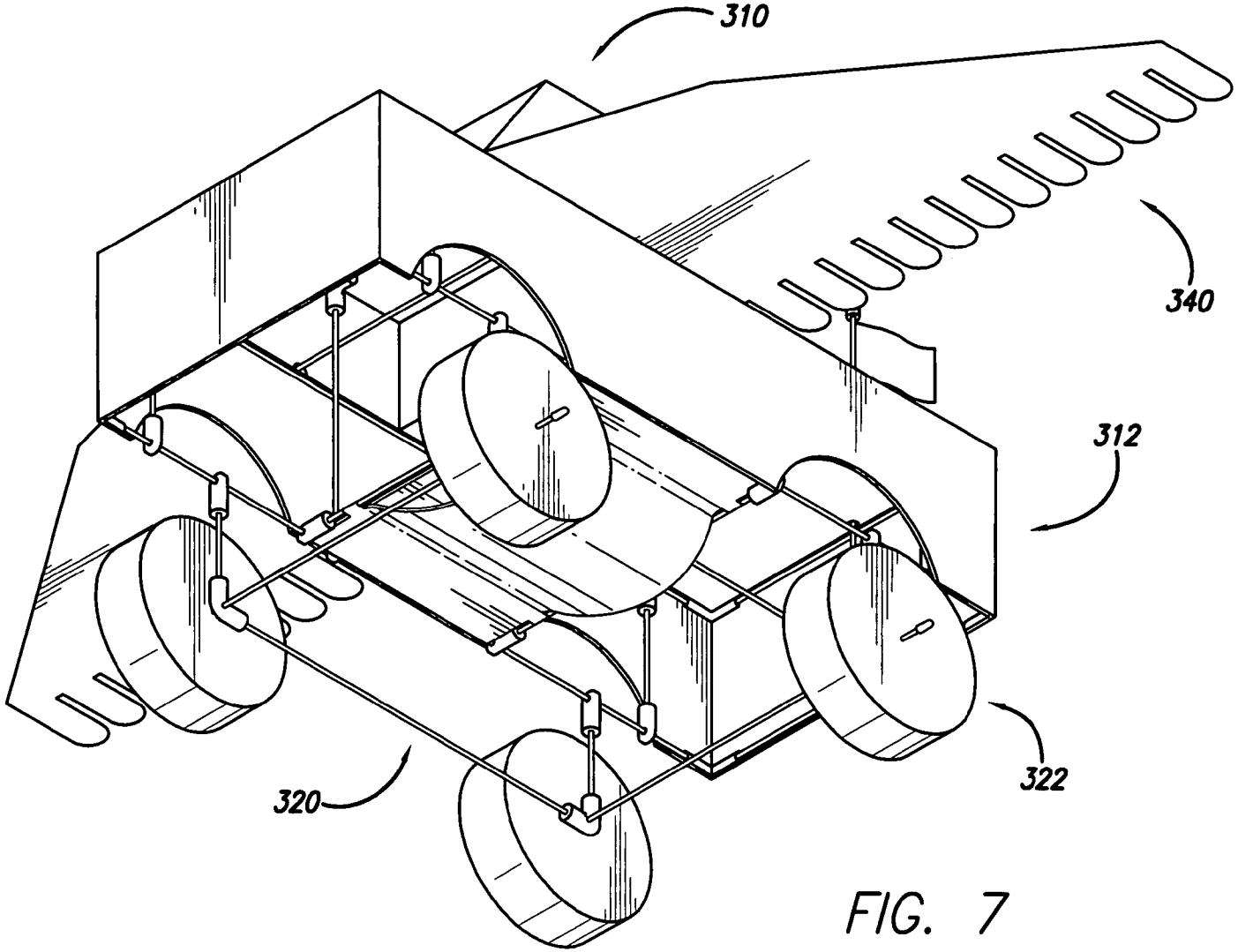
FIG. 7 is a perspective view of an exemplary embodiment.

FIG. 7 is an exemplary embodiment of a system, which may be of the likeness of a pickup truck, generally at 310. System 310 may include a kite portion 312. Here the system may be in a form similar to a large pickup truck or monster truck, with or without a driver/rider. It will be appreciated that the system may be in the form of a other vehicles, including, but not limited to, sports cars, race cars, classic cars, other type of truck, and the like. Kite portion 312 may include sails 340, which may provide stability and lift for the system.

System 310 may include substructure 320, which may be all, partially or not exposed. System 310 may include wheels 322, which may alter the flight characteristics of the system, and/or may add to the aesthetic appeal of the system. Furthermore, substructure 320 may add stability to the system, which may allow the system to operate better and more consistently.

It will be appreciated that although the system is shown as a boat, sailboard, golf green, motorcycle and rider or other vehicles, many other designs may be utilized, as desired. Besides being in the form of a human, the ballast may also be in the form of an animal, fanciful or whimsical creature, or inanimate object. Furthermore, the kite itself may be in the form of various vehicles and other objects, including fanciful vehicles and objects, which may incorporate a figure including a ship, airplane, car, monster truck, surfboard, snowboard, skateboard, house, etc. Additionally, more than one ballast in accordance with the exemplary embodiments may be attached to a single kite and/or system.

While the examples described herein illustrate a ballast positioned above or atop the surface of the kite, it should be understood that embodiments wherein a ballast(s) are positioned below the kite surface are also contemplated by the present invention. Such embodiments may be advantageous in that the figure may be more readily seen by viewers on the ground, including the user. Additionally, a flexible figure in accordance with the exemplary embodiments may be attached to other flying toys such as gliders, and the like, as desired.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A kite system, comprising:

a kite portion; and a ballast portion coupled to said kite portion that moves with respect to said kite portion;

said kite portion comprising a base and a partially exposed substructure coupled to said base;

wherein said partially exposed substructure flexes said base.

2. The kite system of claim 1, wherein said kite portion further comprises:

one or more masts coupled to said base portion; and one or more sails coupled to said one or more mast portions.

3. The kite system of claim 2, wherein said kite portion further comprises one or more lateral supports coupled to said one or more masts and said base.

4. The kite system of claim 3, further comprising rigging coupled to said base and to said one or more masts.

5. The kite system of claim 1, wherein said base comprises:

a frame; and a body portion coupled to said frame.

6. The kite system of claim 1, wherein said base is in a form similar to a surfboard.

7. The kite system of claim 1, wherein said base is in a form similar to a skateboard.

8. The kite system of claim 1, wherein said base is in a form similar to a golf putting green.

9. The kite system of claim 1, wherein said base flexing by said partially exposed substructure causes said base to resemble a real-life configuration.

10. The kite system of claim 1, wherein said ballast portion comprises:

a shell portion; and fill material located within said shell portion.

11. The kite system of claim 10, wherein said ballast portion further comprises one or more coupling structures configured to couple to themselves and to said kite portion.

12. The kite system of claim 10, wherein said ballast portion further comprises one or more mesh portions coupled to said shell portion configured to allow air to pass therethrough to the interior of said ballast.

13. The kite system of claim 1, wherein said ballast portion is coupled to said kite above said base.

14. The kite system of claim 1, wherein said ballast portion is removably, selectively, positionally coupled to said kite portion.

15. The kite system of claim 1, wherein said ballast portion moves periodically or intermittently with respect to said kite portion when in flight.

16. The kite system of claim 1, wherein said ballast portion is a human-like form.

17. The kite system of claim 1, wherein said ballast portion is an animal-like form.

18. The kite system of claim 1, wherein said ballast portion is a whimsical form.

19. A kite system, comprising:

a kite portion including a base, a partially exposed substructure coupled to said base; and a ballast portion comprising a shell, fill material within said shell and one or more coupling structures configured to couple said ballast portion to said kite portion for periodic or intermittent movement relative to said kite portion in flight.

20. A method of using a kite system comprising a kite portion, including coupling a substantially exposed substructure to said kite portion in flight stabilizing relation; and maintaining a ballast portion comprising a shell portion and a fill material within said shell portion attached to said kite portion that moves relative to said kite portion in flight.

21. A kite system, comprising:

a kite portion having a base resembling a truck; and a partially exposed substructure coupled to said base in flexing relation;

wherein said substructure comprises four or more rods and wheel-like devices arranged to appear as truck wheels supported by said substructure rods.

22. The kite system of claim 21, further comprising wings coupled to said base.

23. A kite system, comprising:

a kite portion; and a ballast portion coupled to said kite portion that moves with respect to said kite portion;

wherein said kite portion comprises a partially exposed substructure coupled to a base; and wherein said partially exposed substructure flexes said base, such that said base imitates a real-world configuration.

24. The kite system of claim 23, further comprising wings coupled to said base directly above said base.

25. The kite system of claim 23, wherein said substructure is a single element.

* * * * *